US009288569B2

(12) United States Patent
Reimert

(10) Patent No.: US 9,288,569 B2
(45) Date of Patent: Mar. 15, 2016

(54) EARPHONE WITH NOISE REDUCTION

(71) Applicant: GN Netcom A/S, Ballerup (DK)

(72) Inventor: Jacob Reimert, Ballerup (DK)

(73) Assignee: GN Netcom A/S (DK)

( * ) Notice: Subject to any disclaimer, the term of this patent is extended or adjusted under 35 U.S.C. 154(b) by 75 days.

(21) Appl. No.: 14/332,820

(22) Filed: Jul. 16, 2014

(65) Prior Publication Data

US 2015/0023515 A1 Jan. 22, 2015

(30) Foreign Application Priority Data

Jul. 18, 2013 (DK) ..... 2013 00435
Oct. 11, 2013 (EP) ..... 13188282

(51) Int. Cl.
*H04R 1/10* (2006.01)
*H04R 1/28* (2006.01)
*H04R 3/00* (2006.01)

(52) U.S. Cl.
CPC ..... *H04R 1/1083* (2013.01); *H04R 1/1008* (2013.01); *H04R 1/2819* (2013.01); *H04R 1/2834* (2013.01); *H04R 3/002* (2013.01); *H04R 2410/05* (2013.01); *H04R 2460/01* (2013.01)

(58) Field of Classification Search
CPC ..... H04R 1/1083; H04R 1/1008; H04R 2460/01; H04R 2410/05; H04R 1/2819; H04R 3/002; H04R 1/2834; H04R 5/033; H04R 1/1075; H04R 1/1066
USPC ..... 381/74, 71.6, 71.13, 370, 373, 184, 186
See application file for complete search history.

(56) References Cited

U.S. PATENT DOCUMENTS

RE37,398 E * 10/2001 Nageno ..... H04R 5/033 381/370
6,831,984 B2 * 12/2004 Sapiejewski ..... H04R 1/2819 181/182
2011/0243361 A1 10/2011 Koike
2014/0334656 A1 * 11/2014 Lu ..... H04R 1/10 381/370

FOREIGN PATENT DOCUMENTS

EP 0589623 3/1994
EP 0873040 10/1998
JP 2008066976 3/2008
WO WO 2007/000485 1/2007

* cited by examiner

*Primary Examiner* — Vivian Chin
*Assistant Examiner* — David Ton
(74) *Attorney, Agent, or Firm* — Altera Law Group, LLC

(57) ABSTRACT

An earphone simultaneously allows high-level low-frequency sound and effective noise reduction. The earphone has a front cavity separated from ambient space The earphone has a housing having a wall separating a rear cavity with an acoustic compliance from the front cavity and from ambient space; a first diaphragm reciprocatably suspended across a first through hole in the housing wall between the front cavity and the rear cavity and adapted to be actively driven to provide the acoustic output signal; and a second diaphragm reciprocatably suspended in the housing wall between the rear cavity and ambient space where the acoustic resonant system is configured such that the resonance frequency is below 500 Hz. The second diaphragm attenuates acoustic signals entering the rear cavity from ambient space at frequencies above the resonance frequency and virtually increases the acoustic compliance of the rear cavity at frequencies below the resonance frequency.

15 Claims, 8 Drawing Sheets

EARPHONE WITH NOISE REDUCTION

TECHNICAL FIELD

The present invention relates to an earphone with noise reduction, i.e. an earphone adapted to attenuate acoustic noise approaching a wearer's ear. The invention may advantageously be applied in headsets, headphones, hearing protectors and other hearing devices.

BACKGROUND ART

In the art, various earphones are known, which employ passive noise reduction (PNR) to reduce the amount of acoustic noise reaching the wearer's ears. PNR is typically achieved by acoustic dampening in structural components, such as earphone shells and ear cushions. It is further known to combine PNR with active noise cancelling (ANC) that actively counteracts acoustic noise approaching the wearer's ears, thereby attempting to cancel out and thus remove the noise from the sound reaching the ears. ANC is typically achieved by controlling the output of a driver in the earphone such that it counteracts the residual noise that escapes the PNR.

PNR is generally effective at frequencies above about 1 kHz, while the effect decreases towards lower frequencies and is practically non-existing at frequencies below about 100 Hz. Conversely, ANC is generally effective in the frequency range below about 1 kHz, while it is difficult to achieve good results for higher frequencies. Noise reduction using a combination of PNR and ANC can thus in principle be made effective within the entire audio frequency range. At the same time, however, many earphones are intended to reproduce audio in the entire audible frequency range, which includes reproduction of low-frequency sounds. This presents a challenge to the earphone designer, because acoustic output at low frequencies generally requires an acoustically open earphone, while effective PNR requires an acoustically closed earphone.

U.S. Pat. No. 6,831,984 B2 discloses a solution to this problem in a headset. The headset includes an earcup enclosing a front cavity and a back cavity separated by a divider. A driver with a diaphragm is mounted in the divider between the front and back cavity. The headset further includes a circumaural sealing pad constructed and arranged to effectively seal the front cavity to the head of a person. A port and a resistive opening in parallel intercouple the interior and exterior of the enclosure through a wall of the back cavity. The acoustic mass of the port and the compliance of the back cavity are tuned to a resonance frequency of about 300 Hz. This causes the back cavity to behave closed above 300 Hz and open below this frequency. The resistive opening dampens the port resonance, which would otherwise cause a narrow dip at 300 Hz in the sound output to the ear. A disadvantage of the disclosed solution is that sound waves with a frequency above the resonance frequency can nevertheless enter the back cavity through the port and through the resistive opening, partly due to natural resonances in the port, which decreases the effect of the PNR provided by the earcup. The result is a reduction in the total noise reduction, primarily in a broad frequency region around and above 1 kHz where the transition from PNR to ANC takes place.

U.S. Pat. No. 5,497,427 discloses an alternative solution in a similar headphone, which allows the user to manually switch between an open and a closed configuration. Instead of a port and a resistive opening, a diaphragm without a driver is arranged to cover a window hole in the wall of the back cavity.

The diaphragm is tuned to resonate at around 1300 Hz. A lid member can be manually attached to shut the window hole or be removed to open the window hole. With the lid member removed, sound is not attenuated in the low-pitched sound range, and external sounds can also be heard. Therefore, the user can hear reproduced sound of music and the like while playing sports outdoors or taking a walk. The headphone can also be used as a general closed type headphone by using it with the window hole closed by shutting it with the lid member. In this case, some attenuation of the sound in the low-pitched sound range is present, while the external sound is scarcely heard. Obviously, the disclosed alternative solution does not allow simultaneously achieving high-level low-frequency sound and effective PNR.

Japanese Patent 4826399 discloses a variant of the alternative solution, which allows the user to manually move a braking member between a "closed" position wherein the braking member contacts the diaphragm and thus prevents the diaphragm from vibrating and an "open" position wherein the braking member does not contact the diaphragm and thus allows the diaphragm to vibrate. The diaphragm is tuned to resonate at around 1-2 kHz.

DISCLOSURE OF INVENTION

It is an object of the present invention to provide an earphone that does not suffer from the disadvantages of prior art earphones.

This and other objects of the invention are achieved by the invention defined in the independent claims and further explained in the following description. Further objects of the invention are achieved by embodiments defined in the dependent claims and in the detailed description of the invention.

Within this document, the term "earphone" refers to a device that is configured to be worn at, on or in one ear of an individual (the wearer) and is capable of providing an audible acoustic output signal to the wearer. An earphone may itself constitute a hearing device, or it may be comprised by a hearing device, such as e.g. a headset, a headphone, a hearing protector or a hearing aid. Hearing devices may e.g. be used for conveying audio signals in an audible format to a person, for augmenting a normal-hearing person's hearing capability, for protecting a person's hearing capability while allowing the person to hear sounds from the environment and/or for compensating for a hearing-impaired person's loss of hearing capability.

An earphone may e.g. be configured to be worn over the ear (circumaurally), i.e. such that it covers the pinna completely, on the ear (supraurally), i.e. such that it covers a portion of the pinna, or in the ear, i.e. such that a portion of the earphone protrudes towards or into the ear canal. An earphone may be configured in other known ways, including combinations of and compromises between two or more of the above mentioned configurations. An earphone may preferably be retained in position at, on or in the ear by a wearing device, such as e.g. a headband, a neckband, an earhook or the like. The wearing device may be an integral part of the earphone and/or of the hearing device. For example, the housing of an earbud or earplug earphone may have a shape that fits into the concha and thus allows the housing itself to function as a wearing device. As another example, a hearing-device part comprising e.g. electronics may be adapted to be arranged behind the ear and be connected to an earbud or earplug earphone adapted to be arranged in the ear, and the behind-the-ear part may thus function as an earhook. An earphone is preferably configured to emit an acoustic signal such that it may enter the wearer's ear canal and thus may be heard by the wearer.

In general, a hearing device is configured to be worn—at least partly—at or on the wearer's head, typically comprises one or two earphones and is capable of providing one or more audible acoustic output signals to at least one of the wearer's ears. A hearing device may thus be monaural or binaural. One or more of the acoustic output signals are preferably provided in the form of an air-borne acoustic signal that is emitted such that it may reach one or both of the wearer's outer ears. A hearing device may comprise one or more vibration devices, each capable of providing a mechanical vibration signal and adapted to acoustically couple the mechanical vibration signal as an audible acoustic output signal to one or both of the wearer's inner ears through the bone structure of the wearer's head.

A hearing device may provide one or more of the acoustic output signals in dependence on one or more audio input signals, such as e.g. electronically received audio signals, acoustic signals received from the wearer's surroundings and/or audio signals stored or generated in the hearing device. A hearing device may comprise one or more receivers for electronically receiving one or more audio input signals. A receiver may comprise an electric connector, e.g. arranged in a housing part of the hearing device or at the distal end of a cable extending from the hearing device, to which another device may be electrically connected to provide one or more audio input signals. A receiver may be adapted to receive one or more audio input signals wirelessly using any known wireless transmission signals, such as e.g. radio frequency signals, optical signals or acoustic signals. A receiver may be adapted to receive wired or wireless signals as analog signals and/or as digital signals and may comprise demodulators and/or decoders for deriving one or more audio input signals from one or more modulated and/or encoded wired or wireless transmission signals.

A hearing device may comprise one or more input transducers for receiving one or more acoustic input signals from the wearer's surroundings and providing corresponding audio input signals. A hearing device may comprise one or more signal processing circuits adapted to apply any combination of known signal processing, such as e.g. amplification, attenuation, noise reduction, frequency filtering, spatial filtering, reduction of acoustic feedback, level compression etc., in an audio signal path or in multiple audio signal paths receiving the one or more audio input signals and providing the one or more acoustic output signals in dependence on the one or more audio input signals.

A hearing device may comprise one or more own-voice microphones arranged to receive the wearer's voice and adapted to provide one or more corresponding voice audio signals as well as one or more transmitters adapted to transmit one or more voice audio signals to another device connected to the hearing device, such as e.g. base station, a mobile phone, a computer or the like.

In general, an earphone comprises an output transducer for providing an audible acoustic output signal to a wearer in dependence on an audio output signal. An earphone may comprise one or more of the receivers of the hearing device, and/or one or more of the input transducers of the hearing device, and/or one or more of the signal processing circuits of the hearing device, and/or one or more of the own-voice microphones of the hearing device, and/or one or more of the transmitters of the hearing device. Thus, the functions of receiving, providing and/or processing the one or more audio input signals as well as the functions of receiving and/or transmitting voice audio signals may reside entirely in an earphone, or they may be distributed in any suitable fashion between an earphone and further parts of a hearing device comprising the earphone. An earphone may receive the audio output signal from another device. Alternatively, or additionally, an earphone may receive one or more, possibly pre-processed, audio input signals and process one or more of the audio input signals and/or pre-processed audio input signals to provide the audio output signal. In the following, any audio signal received by an earphone is referred to as an "earphone audio signal". An earphone audio signal may thus comprise e.g. an acoustic input signal, an audio input signal, a pre-processed audio input signal and/or an audio output signal. An earphone may e.g. provide one or more received earphone audio signals directly to the output transducer, or it may transduce and/or process one or more received earphone audio signals and provide the one or more transduced and/or processed earphone audio signals to the output transducer.

The term "hearing system" refers to a system comprising multiple devices of which at least one is a hearing device. A hearing system may comprise multiple hearing devices and/or one or more auxiliary devices. Auxiliary devices are devices that communicate with one or more of the hearing devices and affect—and/or benefit from—the function of the hearing devices. Auxiliary devices may be e.g. base stations, remote controls, audio gateway devices, mobile phones, public-address systems, car audio systems, personal computers and/or music players.

Within this document, the singular forms "a", "an", and "the" are intended to include the plural forms as well (i.e. to have the meaning "at least one"), unless expressly stated otherwise. Correspondingly, the terms "has", "includes", "comprises", "having", "including" and "comprising" specify the presence of respective features, operations, elements and/or components, but do not preclude the presence or addition of further entities. Furthermore, when an element is referred to as being "connected" or "coupled" to another element, this includes direct connection/coupling and connection/coupling via intervening elements, unless expressly stated otherwise. The term "and/or" includes any and all combinations of one or more of the associated items. The steps or operations of any method disclosed herein need not be performed in the exact order disclosed, unless expressly stated otherwise. Ordinal attributes, such as "primary", "secondary", "main" and "auxiliary", are intended to allow the reader to distinguish between different elements, and should not be construed as implying any element hierarchy or dependency, unless expressly stated otherwise.

BRIEF DESCRIPTION OF THE DRAWINGS

The invention will be explained in more detail below in connection with preferred embodiments and with reference to the drawings in which.

The figures are schematic and simplified for clarity, and they just show details essential to understanding the invention, while other details may be left out. Where practical, like reference numerals and/or names are used for identical or corresponding parts.

MODE(S) FOR CARRYING OUT THE INVENTION

Figure 1:
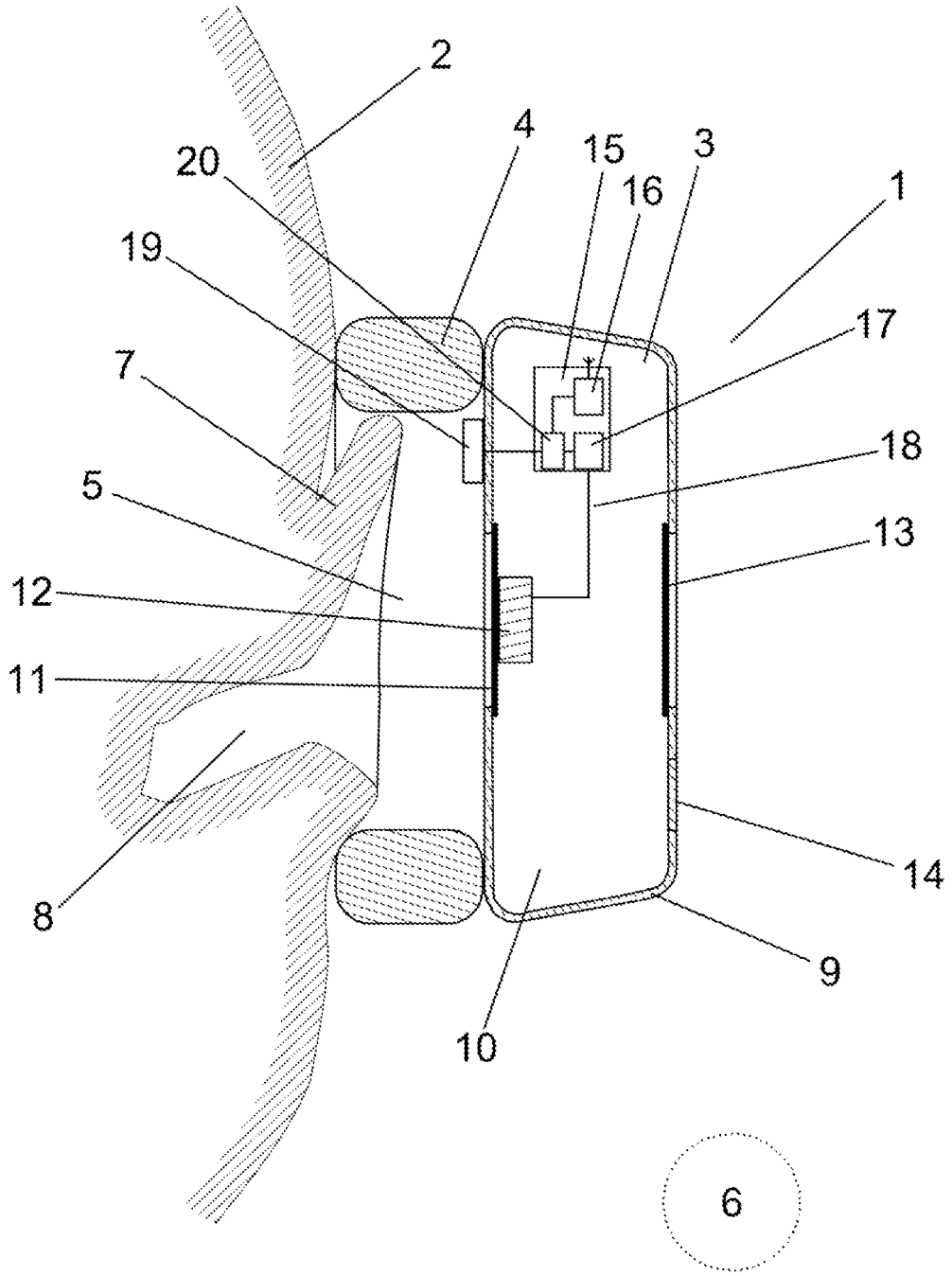
FIG. 1 shows a first embodiment of an earphone according to the invention.

FIG. 1 shows an earphone 1 arranged in an operating position on the head 2 of a user or wearer of the earphone 1. The earphone 1 comprises a housing 3 with an annular ear cushion 4. The housing 3 and the ear cushion 4 together separate a front cavity 5 between the head 2 and the earphone 1 from ambient space 6 when the earphone 1 is in the operating position. The earphone 1 is adapted to provide an acoustic output signal to an ear 7 of the wearer in dependence on an earphone audio signal, and the operating position is preferably chosen such that the front cavity 5 comprises the ear canal 8 of the ear 7. The ear cushion 4 is arranged and adapted to attenuate acoustic signals entering the front cavity 5 from ambient space 6 when the earphone 1 is in the operating position. The attenuation provided by the ear cushion 4 at frequencies above 1 kHz may preferably be e.g. greater than 20 dB, greater than 10 dB or greater than 6 dB. The ear cushion 4 may be permanently or detachably attached to the housing 3 in any known way, e.g. by means of adhesives, screws, snap couplings and/or bayonet couplings.

The housing 3 has a wall 9 that separates a rear cavity 10 from the front cavity 5 and from ambient space 6. In some embodiments, the front cavity 5 may be substantially larger than the rear cavity 10, in other embodiments, the front cavity 5 and the rear cavity 10 may be comparable in size, and in further embodiments, the rear cavity 10 may be substantially larger than the front cavity 5. A primary diaphragm 11 of an electrodynamic primary driver 12 is reciprocatably suspended across a through hole in the housing wall 9 between the front cavity 5 and the rear cavity 10 and is adapted to be actively driven to provide at least a portion of the acoustic output signal. The primary driver 12 thus functions as an output transducer of the earphone 1. Within this document, a "through hole" in a wall refers to a passage through the wall that fluidly connects the two opposite sides of the wall or—in the case that a diaphragm is suspended across the through hole and thus obstructs the fluid passage—that would fluidly connect the two opposite sides of the wall if the diaphragm were absent. In the earphone 1, the primary diaphragm 11 obstructs the fluid passage through the through hole that would otherwise fluidly connect the front cavity 5 and the rear cavity 10. The primary diaphragm 11 and the rear cavity 10 (more precisely: the air or the gas within the rear cavity 10) together constitute a primary acoustic resonant system 10, 11. In the following, the lowest resonance of the primary acoustic resonant system 10, 11 is referred to as the primary system resonance and the frequency of the resonance is referred to as the primary system resonance frequency. The primary system resonance frequency is controlled mainly by the acoustic mass of the primary diaphragm 11 and the combined acoustic compliance of the air or gas in the rear cavity 10, of the air in the front cavity 5 and of the suspension of the primary diaphragm 11.

A secondary diaphragm 13 is reciprocatably suspended across a through hole in the housing wall 9 between the rear cavity 10 and ambient space 6, such that the secondary diaphragm 13 and the rear cavity 10 together constitute a secondary acoustic resonant system 10, 13. The secondary diaphragm 13 thus obstructs the fluid connection between the rear cavity 10 and ambient space 6 through the through hole. In the following, the fundamental resonance of the secondary acoustic resonant system 10, 13 is referred to as the secondary system resonance and the frequency of the resonance is referred to as the secondary system resonance frequency. The secondary system resonance frequency is controlled mainly by the acoustic mass of the secondary diaphragm 13 and the combined acoustic compliance of the air or gas in the rear cavity 10 and of the suspension of the secondary diaphragm 13. The compliance of the suspension of the secondary diaphragm 13 is preferably chosen such that the lowest resonance frequency of the secondary diaphragm 13 in free air is substantially below the secondary system resonance frequency, such as e.g. below 30% of the secondary system resonance frequency, below 50% of the secondary system resonance frequency or below 70% of the secondary system resonance frequency. Furthermore, the primary driver 12 is preferably configured such that the primary system resonance frequency is substantially below the secondary system resonance frequency, such as e.g. below 30% of the secondary system resonance frequency, below 50% of the secondary system resonance frequency or below 70% of the secondary system resonance frequency. The secondary acoustic resonant system 10, 13 is preferably configured such that the secondary system resonance frequency is below 500 Hz, more preferably between 200 Hz and 400 Hz, more preferably between 200 Hz and 300 Hz. This ensures that the secondary system resonance frequency is well below the frequency range wherein PNC is generally effective.

Note that the actual resonance frequency of the primary acoustic resonant system 10, 11 may be affected by reciprocation of the secondary diaphragm 13 and that the actual resonance frequency of the secondary acoustic resonant system 10, 13 may be affected by reciprocation of the primary diaphragm 11. Therefore, for the purpose of determining the primary system resonance frequency for a particular earphone, reciprocation of the secondary diaphragm 13 should be prevented, and for the purpose of determining the secondary system resonance frequency, reciprocation of the primary diaphragm 11 should be prevented.

The secondary diaphragm 13 attenuates acoustic signals entering the rear cavity 10 from ambient space 6 at frequencies above the secondary system resonance frequency while virtually increasing the acoustic compliance of the rear cavity 10 at frequencies below the secondary system resonance frequency. The earphone 1 thus behaves as an acoustically closed earphone, i.e. an earphone wherein the back side of the driver is closed towards ambient space 6, at frequencies above the secondary system resonance frequency and as an acoustically open earphone, i.e. an earphone wherein the back side of the driver is open towards ambient space 6, at frequencies below the secondary system resonance frequency. Due to the relatively low secondary system resonance frequency, the secondary diaphragm 13 effectively stops middle and high frequency sound and thus improves the noise reduction while allowing low frequency sounds to pass, thus also improving the low-frequency acoustic output of the primary driver 12. The secondary diaphragm 13 thus constitutes an effective hindrance to middle and high frequency sounds. The materials, the dimensions and the suspension of the secondary diaphragm 13 are preferably chosen such that they further support the attenuating effect of the secondary diaphragm 13.

If the secondary diaphragm 13 were left to reciprocate freely at all frequencies, then the secondary diaphragm 13 would be excited by the acoustic signal from the back side of the primary diaphragm 11. Signal frequencies close to the secondary system resonance frequency would cause the secondary diaphragm 13 to reciprocate with relatively large amplitude and with a phase relative to the primary diaphragm 11 that would virtually decrease the compliance of the back cavity 10. This decrease of the compliance of the back cavity 10 would cause a dip in the acoustic output signal from the primary driver 12 around the secondary system resonance frequency. It is therefore desirable to provide dampening of the reciprocation of the secondary diaphragm 13 at the secondary system resonance frequency in order to reduce or prevent the above mentioned dip in the acoustic output signal. In the earphone 1, an acoustically resistive vent 14 is arranged in a further through hole in the housing wall 9 between the rear cavity 10 and ambient space 6 as a dampening means adapted to dampen reciprocation of the secondary diaphragm 13 at the secondary system resonance frequency. Likewise, the secondary diaphragm 13 may be excited by external acoustic noise having a frequency close to the secondary system resonance frequency, and the acoustically resistive vent 14 also dampens reciprocation excited by such noise. The acoustically resistive vent 14 does not, however, provide a substantial dampening of the reciprocation of the secondary diaphragm 13 at frequencies below the secondary system resonance frequency.

The earphone 1 may comprise a signal processing circuit 15, e.g. comprising a receiver 16, adapted to receive an earphone audio signal, such as e.g. a wired or wireless signal comprising an audio input signal. The signal processing circuit 15 may be adapted to process the received earphone audio signal and to provide an audio output signal to the primary driver 12 in dependence on the processed earphone audio signal. The signal processing circuit 15 may preferably comprise an output amplifier 17 that amplifies the audio output signal to provide the signal voltage and current required to drive the primary driver 12. The signal processing circuit 15 and/or the output amplifier 17 may be connected to provide the audio output signal to the primary driver 12 through an output cable 18 or another suitable electric connection.

The earphone 1 may further comprise a primary ANC system, which comprises a primary noise microphone 19 arranged to receive a primary acoustic noise signal within the front cavity 5 and adapted to provide a corresponding primary audio noise signal as well as a primary ANC controller 20 connected to receive the primary audio noise signal and to modify the audio output signal in dependence on the primary audio noise signal in a manner suited to decrease the amount of noise reaching the wearer's ear 7 while allowing the wearer to hear the earphone audio signal or the processed earphone audio signal. The primary ANC system 19, 20 may thus counteract residual noise that escapes the PNR provided by the earphone 1 using the primary driver 12 that also emits the audible acoustic output signal. The primary ANC controller 20 may be comprised by the signal processing circuit 15. The primary ANC system 19, 20 shown in FIG. 1 functions generally as a feed-back ANC system. Alternatively, the primary noise microphone 19 may be arranged to receive a primary acoustic noise signal in ambient space 6 instead, and the primary ANC system 19, 20 may function as a feed-forward ANC system. Optionally, the primary ANC system 19, 20 may function as a combined feed-forward and feed-back ANC system, in which case two primary noise microphones 19 are preferably arranged to receive primary acoustic noise signals, respectively within the front cavity 5 and in ambient space 6, and adapted to provide respective corresponding primary audio noise signals to the primary ANC controller 20, which is preferably adapted to receive the primary audio noise signals and to modify the audio output signal in dependence on the primary audio noise signals.

Generally, an ANC system removes noise by estimating the acoustic signal at a location in space where the noise shall be removed, and controlling the acoustic output of a transducer so that the correlation between the estimated signal and a desired acoustic signal is increased. In the primary ANC system 19, 20, the preferred spatial location for the estimate is at the wearer's eardrum. The primary noise microphone 19 is arranged with its sound inlet within the front cavity 5 in order to allow a good estimate of the acoustic signal at the wearer's eardrum and provides the primary audio noise signal as a measurement signal from which the primary ANC controller 20 may derive the estimated signal. The primary ANC controller 20 also receives the processed earphone audio signal as a reference signal from which the primary ANC controller 20 may derive the desired signal. Alternatively, or additionally, the reference signal may comprise the earphone audio signal or any audio signal dependent on the earphone audio signal, such as e.g. a partly processed earphone audio signal, i.e. a signal tapped from the signal path or paths of the earphone 1 anywhere between the earphone audio signal and the processed earphone audio signal.

The primary ANC controller 20 modifies the audio output signal in dependence on the measurement signal and on the reference signal, and the signal processing circuit 15 provides the modified audio output signal to the primary driver 12 through the output cable 18. The primary ANC controller 20 may alternatively provide a noise cancelling signal in dependence on the measurement signal and on the reference signal to a further driver (not shown) that is arranged and adapted to emit a corresponding acoustic noise cancelling signal into the front cavity 5. In this case, the signal processing circuit 15 preferably provides the processed audio input signal as the audio output signal to the primary driver 12. The latter also applies to embodiments of the earphone 1 without a primary ANC system 19, 20.

The primary ANC controller 20 may execute any known method for active noise cancelling. A simple ANC method may comprise determining an error signal as the difference between the measurement signal and the reference signal and recursively subtracting the error signal from the audio output signal provided to the primary driver 12. Many other suitable ANC methods are known in the art. In any ANC method, known non-unity gains and frequency-dependent transfer functions of the primary driver 12, of the primary noise microphone 19, of the acoustic path between these 12, 19, of the acoustic path between the sound inlet of the primary noise microphone 19 and the wearer's eardrum and/or of further components of signal paths in the earphone 1 may be compensated for, e.g. by appropriate filtering of signals in the primary ANC controller 20. Such compensation is also well known in the art. Preferably, the ANC method implemented in the primary ANC controller 20 comprises estimating an acoustic signal within the front cavity 5 in dependence on the primary audio noise signal, determining a desired acoustic signal in dependence on the earphone audio signal, and adaptively controlling the primary driver 12 or the further driver in a manner suited to increase the correlation between the estimated acoustic signal and the desired acoustic signal. The ANC method may preferably be limited to operate within a pre-defined frequency band, such as e.g. 10 Hz-1 kHz. A sound inlet of the primary noise microphone 19 may preferably be arranged close to the primary diaphragm 11, e.g.

within 1 cm, within 5 mm or within 2 mm from the primary diaphragm 11, in order to allow for achieving a reliable estimate of the acoustic signal.

Figure 2:
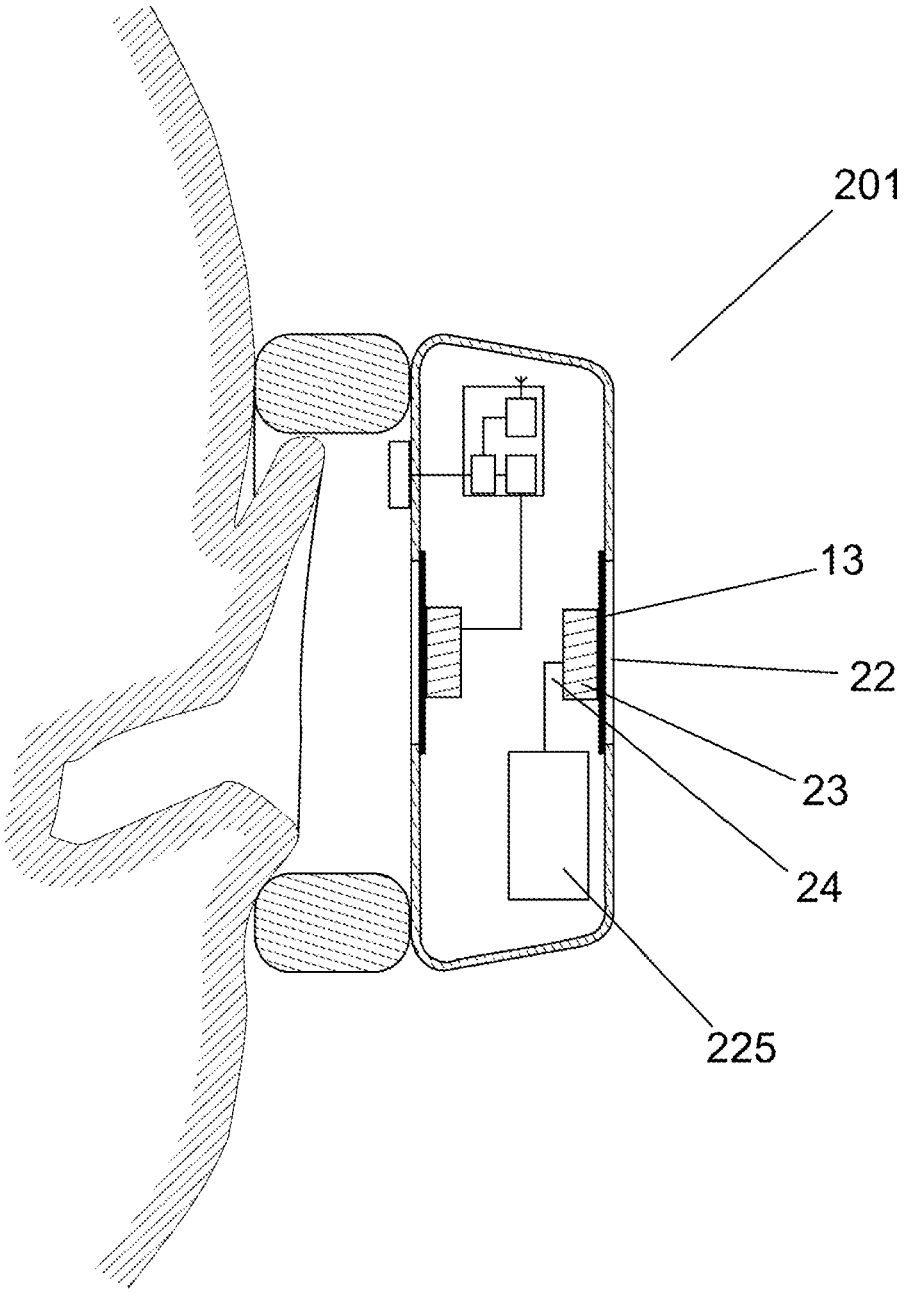
FIG. 2 shows a second embodiment of an earphone according to the invention.

FIG. 2 shows an earphone 201, which may be equal or similar to the earphone 1 of FIG. 1, however with the differences described in the following. In the earphone 201, the acoustically resistive vent 14 is omitted and the secondary diaphragm 13 is comprised by an electrodynamic secondary driver 22 also comprising a driving coil 23 with electric terminals 24. The driving coil 23 is suspended in a permanent magnetic field and mechanically connected to the secondary diaphragm 13, such that reciprocation of the secondary diaphragm 13 may produce an oscillating voltage across the electric terminals 24 and/or vice versa. Suitable drivers may be readily found in the art. The electric terminals 24 are electrically connected to an electronic dampening circuit 225 adapted to dampen reciprocation of the secondary diaphragm 13 at the secondary system resonance frequency.

The electronic dampening circuit 225 may preferably comprise one or more passive electronic components, such as inductors L, capacitors C and/or resistors R (see FIG. 3), which together function as a filter that presents a frequency-dependent electric load to the driving coil 23 and dampens reciprocation of the secondary diaphragm 13 at the secondary system resonance frequency while allowing reciprocation at frequencies below the secondary system resonance frequency. The dampening provided by the electronic dampening circuit 225 at the secondary system resonance frequency may preferably exceed the dampening provided at half the secondary system resonance frequency by e.g. more than 20 dB, more than 10 dB or more than 6 dB. The electronic dampening circuit 225 may thus be used to dampen the resonance electronically instead of, or in addition to, any acoustic dampening means, such as e.g. the acoustically resistive vent 14 provided in the earphone 1 of FIG. 1.

Figure 3:
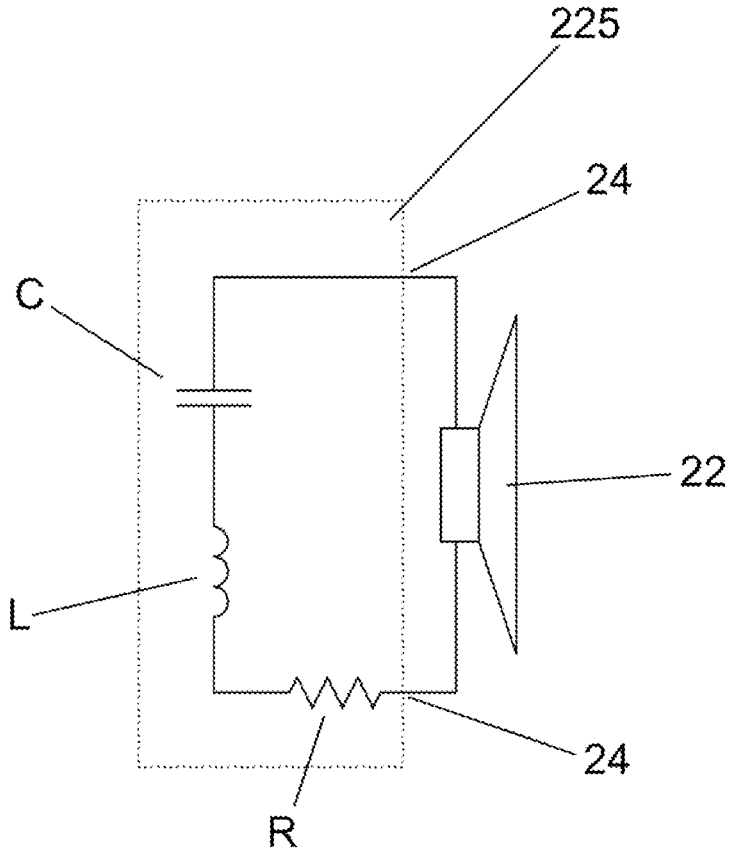
FIG. 3 shows an embodiment of an electronic dampening circuit of the earphone of FIG. 2.

FIG. 3 shows an example configuration of the electronic dampening circuit 225 of the earphone 201 shown in FIG. 2. The electronic dampening circuit 225 comprises an inductor L, a capacitor C and a resistor R connected in series between the terminals 24 of the secondary driver 22. The inductance of the inductor L and the capacitance of the capacitor C are chosen such that the electronic dampening circuit 225 and the secondary driver 22 have an electric resonance frequency equal to the secondary system resonance frequency. At the electric resonance frequency, the impedance of the filter provided by the electronic dampening circuit 225 is at a minimum and the electronic dampening circuit 225 provides maximum dampening of the reciprocation of the secondary diaphragm 13. At frequencies respectively above and below the electric resonance frequency, the electric load provided by the filter 225 does not, however, provide substantial dampening of the reciprocation of the secondary diaphragm 13.

The resistance of the resistor R may be chosen to provide a desired amount of dampening of the reciprocation of the secondary diaphragm 13 at the secondary system resonance frequency. Alternatively, the resistor R may be omitted, i.e. replaced with a shortcut, to increase the dampening provided by the electronic dampening circuit 225. Also, the inductor L may be omitted, i.e. replaced with a shortcut, in which case the electronic dampening circuit 225 provides dampening also above the secondary system resonance frequency. It is, however, generally desirable that the secondary diaphragm 13 is allowed to reciprocate freely at frequencies below the secondary system resonance frequency so that the earphone 1 may function as an acoustically open earphone in this frequency range.

Figure 4:
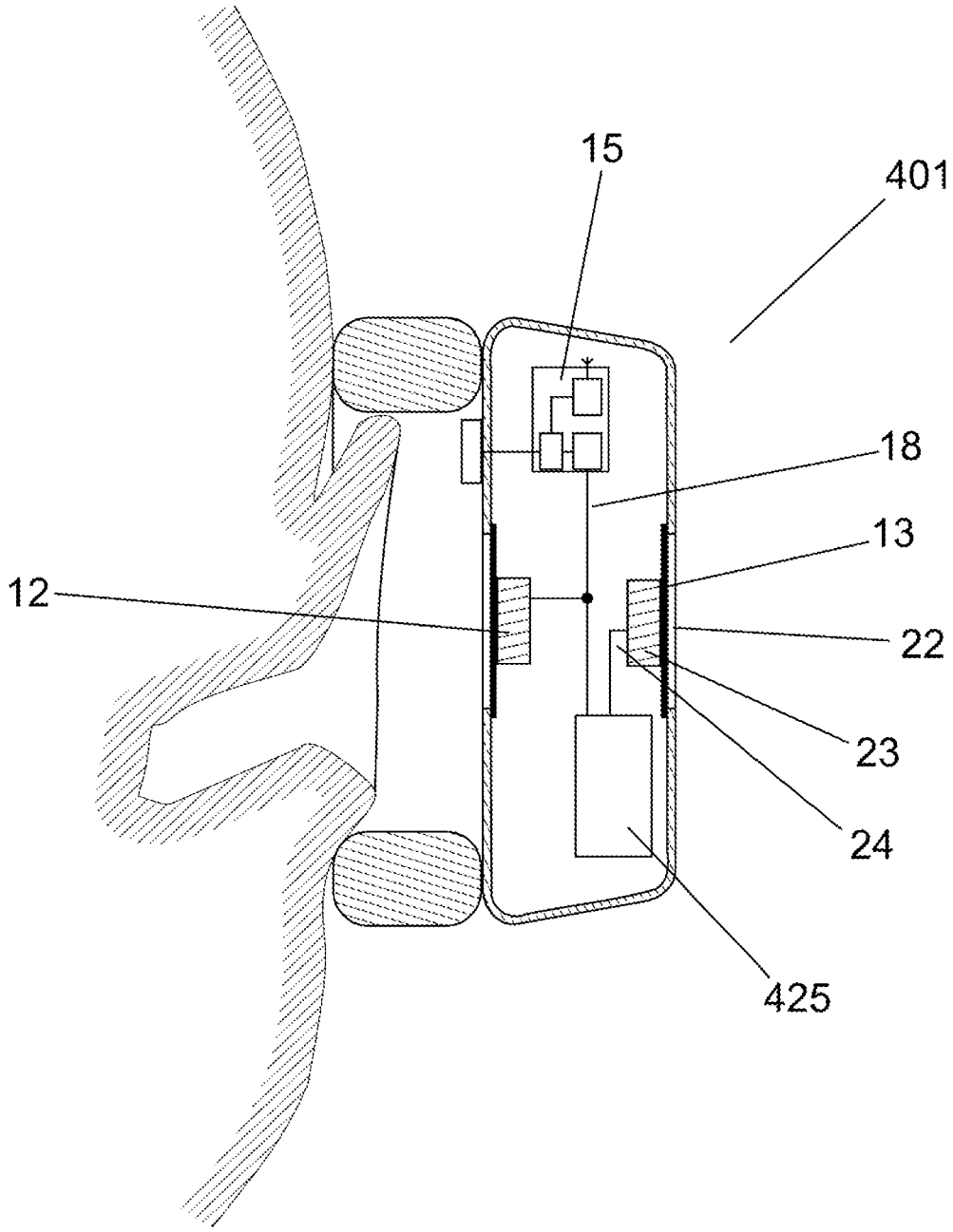
FIG. 4 shows a third embodiment of an earphone according to the invention.

FIG. 4 shows an earphone 401, which may be equal or similar to the earphone 201 of FIG. 2, however with the differences described in the following. In the earphone 401, the audio output signal from the signal processing circuit 15 is further provided through a branch of the output cable 18 to the electronic dampening circuit 425, which is configured differently from the electronic dampening circuit 225 shown in FIG. 2 and FIG. 3.

Figure 5:
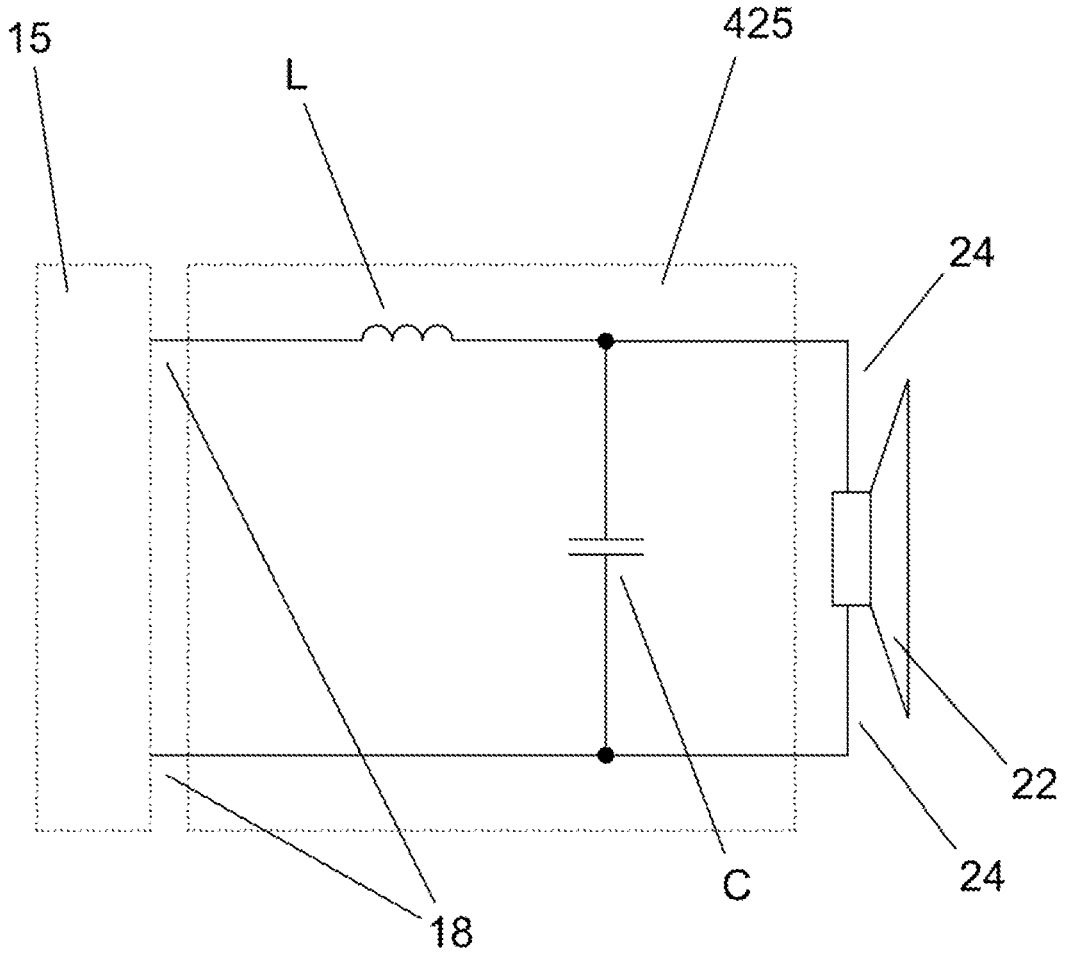
FIG. 5 shows an embodiment of an electronic dampening circuit of the earphone of FIG. 4.

FIG. 5 shows an example configuration of the electronic dampening circuit 425 of the earphone 401 shown in FIG. 4. The electronic dampening circuit 425 comprises an inductor L and a capacitor C. The capacitor C is connected across the terminals 24 of the secondary driver 22. The inductor L is connected between a terminal 24 of the secondary driver 22 and one lead of the output cable 18 that leads the audio output signal from the signal processing circuit 15 to the electronic dampening circuit 425. The other lead 18 is connected to the other terminal 24 of the secondary driver 22. The inductor L and the capacitor C—and thereby the electronic dampening circuit 425—thus function as a low-pass filter between the output cable 18 and the secondary driver 22, which low-pass filters the audio output signal before providing it to the secondary driver 22. The polarity of the signal provided to the secondary driver 22 and the cut-off frequency of the low-pass filter 425 is chosen such that the force provided by the driving coil 23 counteracts free reciprocation of the secondary diaphragm 13 at the secondary system resonance frequency. They are preferably further chosen such that the secondary diaphragm 13 supports and/or does not counteract reciprocation of the primary diaphragm 11 at frequencies below the secondary system resonance frequency.

When the signal processing circuit 15 is not powered on, or—in the case that it is replaced with a simple connector for receiving an earphone audio signal from another device—if this other device is powered off or disconnected, the capacitor C will continue to dampen reciprocation of the secondary diaphragm 13 at and above the secondary system resonance frequency. Thus, the secondary diaphragm 13 may also improve the noise reduction of the earphone 1 in this situation. In alternative embodiments of the electronic dampening circuit 425, the inductor L may be replaced by a resistor (not shown), which, however, changes the cut-off slope of the low-pass filter 425. In other embodiments, the filter 425 may be configured as a band-pass filter centered around the secondary system resonance frequency and having a filter bandwidth. The filter bandwidth may e.g. be made equal to the bandwidth of the secondary system resonance. The filter 425 may be implemented e.g. as a passive filter, as an analog active filter or as an active digital filter. The dampening provided by the electronic dampening circuit 425 at the secondary system resonance frequency may preferably exceed the dampening provided at half the secondary system resonance frequency by e.g. more than 20 dB, more than 10 dB or more than 6 dB.

Providing the signal to the secondary driver 22 in dependence on the audio output signal provided to the primary driver 12 allows achieving improved control of the reciprocation of the primary and secondary drivers 12, 22. This may further increase the perceived quality of the acoustic output signal provided to the wearer and may also increase the stability and the effectiveness of the primary ANC system 19, 20. In the embodiment shown in FIG. 4, the audio output signal is branched off to the electronic dampening circuit 425 by the output cable 18. In other embodiments, the same or similar results may be achieved by tapping the signal input to the electronic dampening circuit 425 from other points in the signal path or paths leading from the earphone audio signal to the audio output signal, provided that—where required—the electronic dampening circuit 425 is modified to take into account signal processing occurring in the signal path or paths to the audio output signal after the tapping point, such that the relation between the audio output signal and the signal applied to the secondary driver 22 remain substantially as explained above. In general, the electronic dampening circuit 425 may thus provide an output signal to the secondary driver 22 in dependence on the earphone audio signal.

Figure 6:
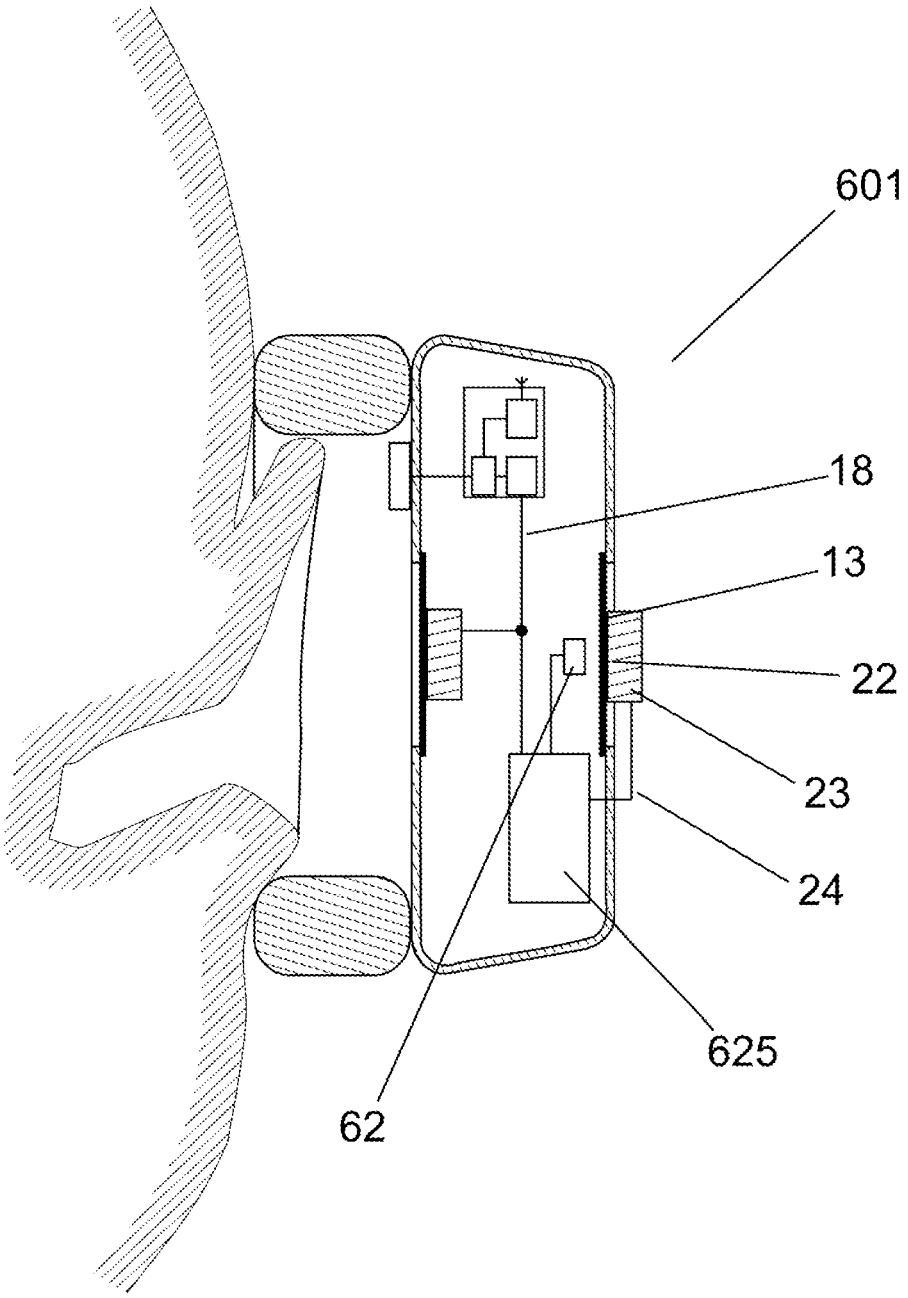
FIG. 6 shows a fourth embodiment of an earphone according to the invention.

FIG. 6 shows an earphone 601, which may be equal or similar to the earphone 401 of FIG. 4, however with the differences described in the following. The earphone 601 comprises a secondary noise microphone 62 arranged to receive a secondary acoustic noise signal within the rear cavity 10 and adapted to provide a corresponding secondary audio noise signal to the electronic dampening circuit 625, which is configured differently from the electronic dampening circuit 425 shown in FIG. 4 and FIG. 5.

Figure 7:
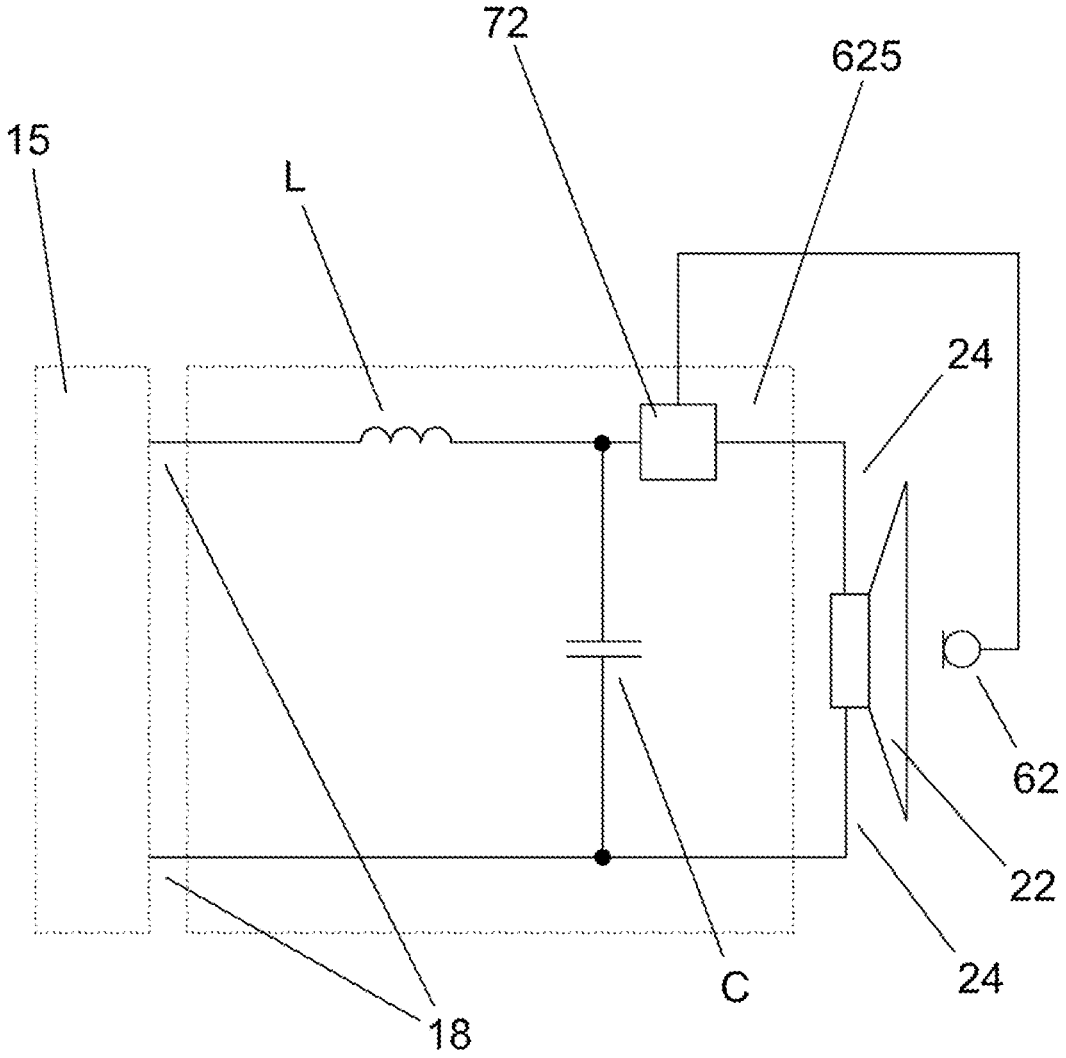
FIG. 7 shows an embodiment of an electronic dampening circuit of the earphone of FIG. 6.

FIG. 7 shows an example configuration of the electronic dampening circuit 625 of the earphone 601 shown in FIG. 6. The electronic dampening circuit 625 comprises an inductor L, a capacitor C and a secondary ANC controller 72. Similarly as in the electronic dampening circuit 425 shown in FIG. 4, the inductor L and the capacitor C function as a low-pass filter, which low-pass filters the audio output signal from the signal processing circuit 15. However, instead of providing the low-pass filtered signal to the secondary driver 22, the low-pass filter L, C provides the low-pass filtered signal as a reference signal to the secondary ANC controller 72. The secondary ANC controller 72 also receives the secondary audio noise signal from the secondary noise microphone 62 as a measurement signal and provides an output signal to the terminals 24 of the secondary driver 22 in dependence on the reference signal, i.e. the low-pass filtered signal, and the measurement signal, i.e. the secondary audio noise signal.

The secondary ANC controller 72 and the secondary noise microphone 62 are comprised by a secondary ANC system 62, 72 that may function in a similar way as the primary ANC system 19, 20 and thus preferably adaptively controls the secondary driver 22 in a manner suited to increase the correlation between an estimated acoustic signal and a desired acoustic signal. The secondary ANC controller 72 preferably derives the estimated signal from the secondary acoustic noise signal within the rear cavity 10 and preferably derives the desired signal from the low-pass filtered signal, and the secondary ANC system may thus control the secondary driver 22 such that the force provided by the driving coil 23 counteracts free reciprocation of the secondary diaphragm 13 at and above the secondary system resonance frequency while allowing reciprocation of the secondary diaphragm 13—and thus supporting and/or not counteracting reciprocation of the primary diaphragm 11—at frequencies below the secondary system resonance frequency. The secondary ANC system 62, 72 may thus further improve the noise reduction provided by the earphone 1, while allowing the primary driver 12 to reproduce low-frequency sounds with good quality.

The above described effects of the secondary ANC system 62, 72 may generally be achieved by setting the desired signal equal to zero at least at the secondary system resonance frequency, and preferably also at frequencies above the secondary system resonance frequency. At frequencies below the secondary system resonance frequency, the desired signal is preferably set equal to the audio output signal provided to the primary driver 12, albeit with a signal phase that causes the secondary diaphragm 13 to support and/or not counteract reciprocation of the primary diaphragm 11. The considerations made further above regarding the primary ANC system 19, 20 apply mutatis mutandi to the secondary ANC system 62, 72. For instance, in the secondary ANC system 62, 72, the preferred spatial location for the acoustic signal estimate is close to the secondary diaphragm 13 inside the rear cavity 10. Furthermore, the secondary ANC controller 72 may alternatively derive the desired signal from a reference signal comprising the earphone audio signal or any audio signal dependent on the earphone audio signal, such as e.g. a fully or partly processed earphone audio signal. The filtering provided by the inductor L and the capacitor C, and/or any other required or desired filtering, may preferably be implemented in the secondary ANC controller 72 instead, e.g. as part of the ANC method executed by the ANC controller 72. In this case, the filter L, C may be omitted, and the secondary ANC controller 72 may receive the reference signal directly from the signal processing unit 15, e.g. through the output cable 18. Also, the secondary ANC controller 72 may execute any known method for active noise cancelling, such as e.g. the simple ANC method mentioned earlier. In any ANC method, non-unity gains and frequency-dependent transfer functions of the secondary driver 22, of the secondary noise microphone 62, of the acoustic path between these 22, 62, and/or of further components of signal paths in the earphone 1 may be compensated for, e.g. by appropriate filtering of signals in the secondary ANC controller 72.

Preferably, the ANC method implemented in the secondary ANC controller 72 comprises estimating an acoustic signal within the rear cavity 10 in dependence on the secondary audio noise signal, determining a desired acoustic signal in dependence on the earphone audio signal, and adaptively controlling the secondary driver 22 in a manner suited to allow the force provided by the driving coil 23 to counteract free reciprocation of the secondary diaphragm 13 at the secondary system resonance frequency while allowing reciprocation of the secondary diaphragm 13—and thus supporting and/or not counteracting reciprocation of the primary diaphragm 11—at frequencies below the secondary system resonance frequency. Preferably, the ANC method further comprises controlling the secondary driver 22 in a manner suited to allow the force provided by the driving coil 23 to counteract free reciprocation of the secondary diaphragm 13 at frequencies above the secondary system resonance frequency. The ANC method may preferably be limited to operate within a pre-defined frequency band, such as e.g. 10 Hz-1 kHz. A sound inlet of the secondary noise microphone 62 may preferably be arranged close to the secondary diaphragm 13, e.g. within 1 cm, within 5 mm or within 2 mm from the secondary diaphragm 13, in order to allow for achieving a reliable estimate of the acoustic signal.

Figure 8:
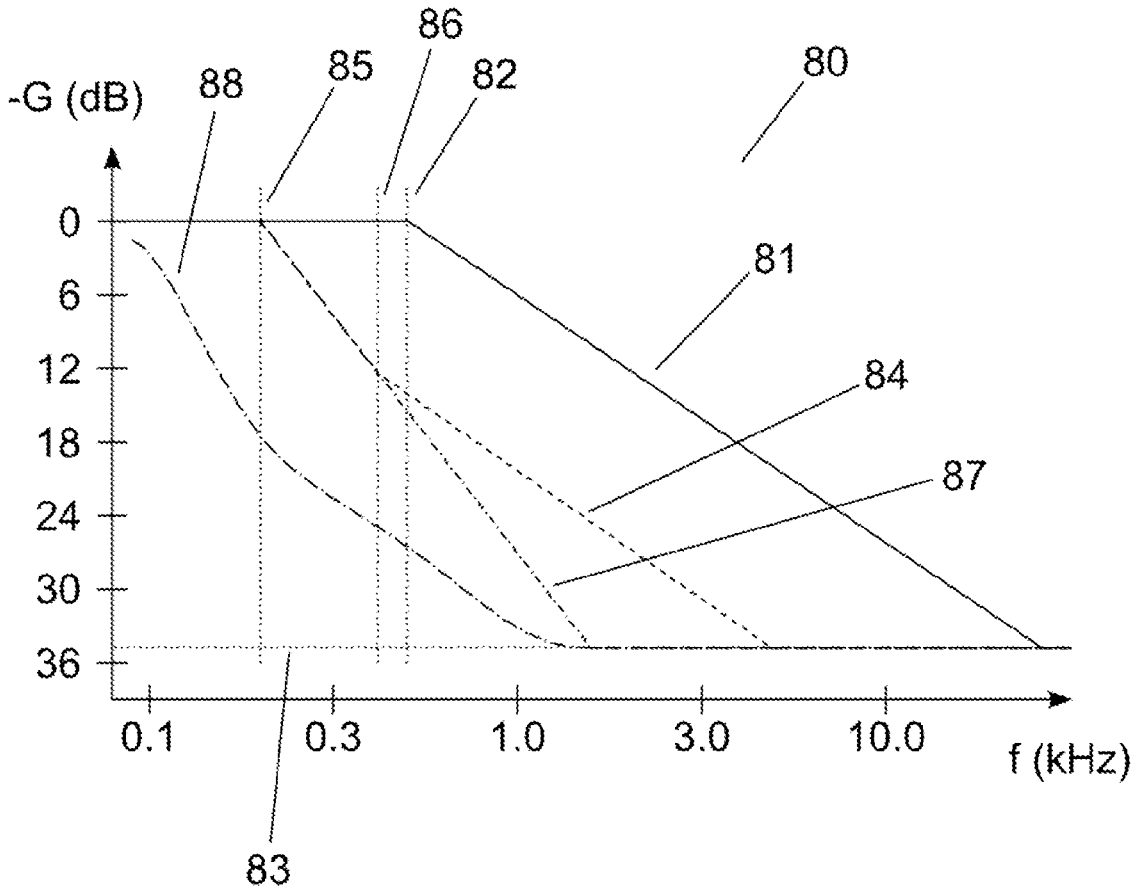
FIG. 8 shows example frequency-dependent noise attenuation curves for the earphones of FIGS. 1, 2, 4 and 6.

FIG. 8 shows a simplified diagram 80 with example frequency-dependent noise attenuation curves 81, 84, 87, 88 for noise entering the front cavity 5 from ambient space 6 in different earphone configurations without a primary ANC system 19, 20. At any frequency f, the noise attenuation-G is defined as the noise level in ambient space 6 just outside the earphone housing 3 minus the noise level within the front cavity 5.

The first noise attenuation curve 81 exemplifies a noise attenuation-G that may be achieved in a simple, acoustically closed prior art earphone with a vent opening fluidly connecting the rear cavity 10 and ambient space 6 and a decent low-frequency reproduction, however without a secondary diaphragm 13. The noise attenuation-G is practically zero below a first frequency 82 of about 500 Hz and increases with about 6 dB per octave from the first frequency 82 towards higher frequencies until it reaches a maximum attenuation 83 at about 35 dB. The maximum attenuation 83 is a limit mainly caused by leaks through the ear cushion and/or the mechanical structure of the earphone. The first noise attenuation curve 81 serves as a reference for illustrating achievable noise attenuation-G in embodiments of earphones 1, 201, 401, 601 according to the invention.

The second noise attenuation curve 84 exemplifies a noise attenuation-G that may be achieved in the earphone 1 shown in FIG. 1. The noise attenuation-G is practically zero below a second frequency 85. The secondary diaphragm 13 causes the noise attenuation-G to increase with about 12 dB per octave from the second frequency 85 up to a third frequency 86 above which leaks through the acoustically resistive vent 14 begin to dominate, so that from the third frequency 86, the noise attenuation-G increases with about 6 dB per octave until it reaches the maximum attenuation 83. As can be seen, the earphone 1 shown in FIG. 1 may provide a larger noise attenuation-G in the frequency range above the second frequency 85 than the prior art earphone exemplified by the first noise attenuation curve 81.

The third noise attenuation curve 87 exemplifies a noise attenuation-G that may be achieved in the earphones 201, 401 shown in FIG. 2 and FIG. 4. Again, the noise attenuation-G is practically zero below the second frequency 85. Due to the electronic dampening of the secondary diaphragm 13 provided by the respective electronic dampening circuits 225, 425, the acoustically resistive vent 14 can be omitted and the noise attenuation-G thus increases with about 12 dB per octave above the second frequency 85 until it reaches the maximum attenuation 83. As can be seen, the earphones 201, 401 shown in FIG. 2 and FIG. 4 may provide a larger noise attenuation-G in the frequency range above the third frequency 86 than the earphone 1 shown in FIG. 1.

The fourth noise attenuation curve 88 exemplifies a noise attenuation-G that may be achieved in the earphone 601 shown in FIG. 6. In addition to providing improved dampening of the secondary diaphragm 13, the secondary ANC system 62, 72 comprised by the earphone 601 may actively counteract noise entering the front cavity 5, e.g. through the ear cushion 4, through structural components of the housing 4 and/or through the secondary diaphragm 13. This extra noise attenuation caused by the secondary ANC system 62, 72 is mainly effective at frequencies above about 10-20 Hz and below about 1 kHz. As can be seen, the earphone 601 shown in FIG. 6 may thus provide a larger noise attenuation-G in this frequency range than the earphones 201, 401 shown in FIG. 2 and FIG. 4. In embodiments of the earphone 601 comprising a primary ANC system 19, 20, the secondary ANC system 62, 72 thus assists the primary ANC system 19, 20, which may therefore be configured differently than in prior art earphones. For instance, the primary ANC system 19, 20 may be configured to have e.g. a reduced maximum operating frequency and/or reduced loop gain in specific frequency ranges, which allows increasing the total noise cancelling effect of the earphone 601 without risking instability of the primary ANC system 19, 20.

In any embodiment of the earphone 1, 201, 401, 601, any of the primary ANC controller 20 and the secondary ANC controller 72 may be implemented as ANC controllers known in the art. In any embodiments, the primary ANC system 19, 20 may be omitted. The secondary ANC system 62, 72 may be included in embodiments of the earphone 601 without a primary ANC system 19, 20.

In the embodiments of the earphone 1, 201 shown in FIGS. 1 and 2, the secondary diaphragm 13 is driven solely by acoustic energy, and in these embodiments, the secondary diaphragm 13 may thus be classified as a passive radiator. In the embodiments of the earphone 401, 601 shown in FIGS. 4 and 6, the secondary diaphragm 13 is driven at least partly by electric energy, and in these embodiments, the secondary diaphragm 13 may thus be classified as an active radiator, at least within those frequency ranges where the signal provided to the secondary driver 22 is non-zero, i.e. around the system resonance frequency—and optionally above the system resonance frequency. In any embodiment of the earphone 1, 201, 401, 601, the primary driver 12 and/or the secondary driver 22 may alternatively be implemented as e.g. electrostatic drivers or as other types of suitable electro-acoustic output transducers known in the art.

In any embodiment of the earphone 1, 201, 401, 601, properties of the dampening means 14, 225, 425, 62, 625, such as e.g. dimensions of the acoustically resistive vent 14, component values L, C, R, filter cut-off frequencies, filter bandwidths, etc., are preferably configured or tuned such that the earphone 1, 201, 401, 601 has a desired transfer function between the earphone audio signal and the acoustic output signal provided by the primary driver 12—or at least has a transfer function that comes close to such a desired transfer function. Such configuring or tuning may preferably be made during designing of a particular earphone type and/or during manufacturing of earphone devices, and may comprise execution of known tuning methods, including e.g. experimentation and simulation as well as automatic or manual tuning of the electronic, mechanic and/or acoustic circuits involved.

In any embodiment of the earphone 1, 201, 401, 601, portions of the signal processing circuit 15, such as e.g. the receiver 16 and/or the output amplifier 17, may be omitted and/or replaced with other known signal processing means. In any embodiment of the earphone 1, 201, 401, 601, the entire signal processing circuit 15 may be omitted and replaced by e.g. a connector for receiving the earphone audio signal and providing it unmodified to the primary driver 12. Any embodiment of the earphone 1, 201, 401, 601 may be adapted to receive two or more earphone audio signals and to provide the acoustic output signal in dependence on one or more of the two or more earphone audio signals. Any embodiment of the earphone 1, 201, 401, 601 may comprise two or more output transducers 12 for providing at least portions of the acoustic output signal, e.g. operating in different frequency ranges. Any embodiment of the earphone 1, 201, 401, 601 may comprise one or more batteries or accumulators for supplying electric power to the signal processing circuit 15 and other electronic circuits comprised by the earphone 1, 201, 401, 601. Note that required power and ground connections are not necessarily shown in the FIGS.

In any embodiment of the earphone 1, 201, 401, 601, the ear cushion 4 may have any shape, texture and material properties suitable for providing an acoustic seal between the head 2 and the earphone 1 without restricting sound flow from the primary diaphragm 11 to the ear canal 8. Suitable shapes include annular shapes, such as e.g. toroid shapes, nearly annular shapes, such as e.g. elliptic, oval or rounded-square shapes or distorted toroid shapes, bowl-like shapes, etc. The ear cushion 4—or at least a portion hereof—is preferably resilient and may e.g. comprise foam, rubber and/or silicone and other suitable materials known in the art. The earphone 1, 201, 401, 601 and the ear cushion 4 may e.g. be adapted for circumaural or supraural use. Alternatively, the earphone 1, 201, 401, 601 may be provided as an earplug or earbud earphone, and the ear cushion 4 may be shaped and adapted to provide a seal against the concha and/or the ear canal wall.

Any of the earphones 1, 201, 401, 601 described above may further comprise any suitable combination of the features described above as generally possible features of an earphone. Any of the earphones 1, 201, 401, 601 may be comprised in a hearing device (not shown), such as e.g. a headset, a headphone, a hearing protector or a hearing aid. The hearing device may further comprise any suitable combination of the features described above as generally possible features of a hearing device and may further comprise any suitable combination of further features that are part of known hearing devices. Where suitable, such features may be comprised by the earphone 1, 201, 401, 601.

The primary and/or the secondary ANC controller 20, 72 as well as the electronic dampening circuit 225, 425, 625 are preferably implemented as analog circuits operating on analog signals, but any portions hereof may be implemented as digital circuits operating on digital signals. Other portions of the signal processing circuits 15 as well as other electronic circuits in the earphone 1, 201, 401, 601 and/or in the hearing device are preferably implemented as digital circuits operating on digital signals, but any portions hereof may be implemented as analog circuits operating on analog signals. Where necessary, signal processing circuits 15 and other electronic circuits may comprise analog-to-digital and/or digital-to-analog converters. Functional blocks of digital circuits may be implemented in hardware, firmware or software, or any combination hereof. Digital circuits may perform the functions of multiple functional blocks in parallel and/or in interleaved sequence, and functional blocks may distributed in any suitable way among multiple hardware units, such as e.g. signal processors, microcontrollers and other integrated circuits.

The detailed description given herein and the specific examples indicating preferred embodiments of the invention are intended to enable a person skilled in the art to practice the invention and should thus be seen mainly as an illustration of the invention. The person skilled in the art will be able to readily contemplate further applications of the present invention as well as advantageous changes and modifications from this description without deviating from the scope of the invention. Any such changes or modifications mentioned herein are meant to be non-limiting for the scope of the invention.

The invention is not limited to the embodiments disclosed herein, and the invention may be embodied in other ways within the subject-matter defined in the following claims. As an example, features of the described embodiments may be combined arbitrarily, e.g. in order to adapt a system, a device and/or a method according to the invention to specific requirements.

It is further intended that the structural features of the system and/or devices disclosed herein may be combined with the methods, when appropriately substituted by a corresponding process. Embodiments of the methods generally have the same advantages as the corresponding systems and/or devices.

Any reference numerals and names in the claims are intended to be non-limiting for their scope.

The invention claimed is:

1. An earphone adapted to provide an acoustic output signal to an ear of a wearer in dependence on an earphone audio signal and further adapted to be arranged on the wearer's head in an operating position such that a front cavity between the head and the earphone is separated from ambient space, the earphone comprising:

a housing having a wall separating a rear cavity having an acoustic compliance from the front cavity and from ambient space;

an ear cushion arranged and adapted to attenuate acoustic signals entering the front cavity from ambient space when the earphone is in the operating position;

a first diaphragm reciprocatably suspended across a first through hole in the housing wall between the front cavity and the rear cavity and adapted to be actively driven to provide at least a portion of the acoustic output signal; and a second diaphragm reciprocatably suspended across a second through hole in the housing wall between the rear cavity and ambient space such that the second diaphragm and the rear cavity constitute an acoustic resonant system with an acoustic resonance at a resonance frequency, characterized in that: and wherein the acoustic resonant system is configured such that said resonance frequency is below 500 Hz;

wherein the second diaphragm is adapted to attenuate acoustic signals entering the rear cavity from ambient space at frequencies above said resonance frequency.

2. An earphone according to claim 1 wherein the acoustic resonant system is configured such that said resonance frequency is between 200 Hz and 400 Hz.

3. An earphone according to claim 1 wherein the second diaphragm is adapted to virtually increase the acoustic compliance of the rear cavity at frequencies below said resonance frequency.

4. An earphone according to claim 1 and further comprising a second controller adapted to actively counteract acoustic noise entering the front cavity from ambient space in dependence on an acoustic signal received within the front cavity.

5. A hearing device comprising one or two earphones according to claim 1 and adapted to provide an earphone audio signal to each of the one or two earphones in dependence on one or more audio input signals.

6. An earphone adapted to provide an acoustic output signal to an ear of a wearer in dependence on an earphone audio signal and further adapted to be arranged on the wearer's head in an operating position such that a front cavity between the head and the earphone is separated from ambient space, the earphone comprising:

a housing having a wall separating a rear cavity having an acoustic compliance from the front cavity and from ambient space;

an ear cushion arranged and adapted to attenuate acoustic signals entering the front cavity from ambient space when the earphone is in the operating position;

a first diaphragm reciprocatably suspended across a first through hole in the housing wall between the front cavity and the rear cavity and adapted to be actively driven to provide at least a portion of the acoustic output signal; and a second diaphragm reciprocatably suspended across a second through hole in the housing wall between the rear cavity and ambient space such that the second diaphragm and the rear cavity constitute an acoustic resonant system with an acoustic resonance at a resonance frequency, characterized in that: and wherein the acoustic resonant system is configured such that said resonance frequency is below 500 Hz and further comprising a dampener adapted to dampen reciprocation of the second diaphragm at said resonance frequency while allowing the second diaphragm to reciprocate at frequencies below said resonance frequency.

7. An earphone according to claim 6 wherein the dampener comprises an acoustically resistive vent arranged in a third through hole in the housing wall between the rear cavity and ambient space.

8. An earphone according to claim 6 wherein the second diaphragm (13) is mechanically connected to a driving coil suspended in a magnetic field and wherein the dampener comprises an electronic dampening circuit electrically connected to the driving coil.

9. An earphone according to claim 8 wherein the electronic dampening circuit comprises one or more passive electronic components adapted to provide a low-pass filter or a band-pass filter.

10. An earphone according to claim 8 wherein the electronic dampening circuit is connected to receive a first audio signal dependent on the earphone audio signal and to provide a second audio signal to the driving coil in dependence on the first audio signal.

11. An earphone according to claim 10 and further comprising a signal processing circuit adapted to process the earphone audio signal and provide an output audio signal for driving the first diaphragm in dependence on the processed earphone audio signal and wherein the first audio signal is dependent on the output audio signal.

12. An earphone according to claim 10 wherein the electronic dampening circuit comprises a first controller adapted to control reciprocation of the second diaphragm in dependence on an acoustic signal received within the rear cavity.

13. An earphone according to claim 12 wherein the first controller is connected to receive a reference signal dependent on the first audio signal and is further adapted to control reciprocation of the second diaphragm in dependence on the reference signal.

14. A wearable earphone adapted to provide an acoustic output signal to an ear of a wearer in response to an earphone audio signal, where the earphone, in an operating position such that a front cavity between the wearer's head and the earphone is substantially acoustically separated from ambient space the earphone comprising:

a housing having a wall separating a rear cavity having an acoustic compliance from the front cavity and from ambient space;

an ear cushion arranged and adapted to attenuate acoustic signals entering the front cavity from ambient space when the earphone is in the operating position;

a first diaphragm reciprocatably suspended across a first through hole in the housing wall between the front cavity and the rear cavity and adapted to be actively driven to provide at least a portion of the acoustic output signal; and a second diaphragm reciprocatably suspended across a second through hole in the housing wall between the rear cavity and ambient space such that the second diaphragm and the rear cavity constitute an acoustic resonant system with an acoustic resonance at a resonance frequency; wherein the second diaphragm is mechanically connected to a driving coil suspended in a magnetic field and includes a dampener including an electronic dampening circuit electrically connected to the driving coil.

15. A method of reducing ambient noise to a wearer of a wearable earphone capable of providing an acoustic output signal to an ear of the wearer in response to an earphone audio signal, where a front cavity between the head and the earphone is substantially acoustically isolated from ambient space the earphone comprising steps of:

forming an acoustic chamber in a housing having a front and rear cavity with a wall separating the cavities;

locating an ear cushion to attenuate acoustic signals entering the front cavity from ambient space when the earphone is in the operating position;

suspending a first diaphragm reciprocatably across said first through hole in the separating wall, actively driving at least a portion of the acoustic output signal;

creating a second through hole in the housing wall between the rear cavity and ambient space;

suspending a second diaphragm reciprocatably across a second through hole in the housing wall between the rear cavity and ambient space such that the second diaphragm and the rear cavity constitute an acoustic resonant system with an acoustic resonance at a resonance frequency;

mechanically connecting the second diaphragm to a driving coil suspended in a magnetic field; and electrically connecting the dampener to an electronic dampening circuit electrically connected to said driving coil.

* * * * *